US005401927A

United States Patent [19]

Lundell et al.

[11] Patent Number: 5,401,927

[45] Date of Patent: Mar. 28, 1995

[54] SELECTIVELY ILLUMINATED INDICATOR AND METHOD FOR MAKING THE SAME

[75] Inventors: Louis J. Lundell, Buffalo Grove; Steven C. Emmert, Arlington Heights, both of Ill.

[73] Assignee: Motorola, Inc., Schaumburg, Ill.

[21] Appl. No.: 40,682

[22] Filed: Mar. 31, 1993

[51] Int. Cl.[6] ..... H01H 7/00

[52] U.S. Cl. ..... 200/314; 200/512; 200/310; 200/311

[58] Field of Search ..... 200/512, 520, 530, 310, 200/311, 312, 313, 314, 317, 517, 54, 341, 345, DIG. 47; 116/280, 279; 29/622

[56] References Cited

U.S. PATENT DOCUMENTS 4,636,593 1/1987 Novak et al. ..... 200/314
4,683,359 7/1987 Wojtanek ..... 200/314
4,734,679 3/1988 Haskins ..... 200/314
4,997,998 3/1991 Bauer ..... 29/622
5,252,798 10/1993 Kamada ..... 200/314

*Primary Examiner*—Henry J. Recla
*Assistant Examiner*—David J. Walczak
*Attorney, Agent, or Firm*—Kevin D. Kaschke

[57] ABSTRACT

An keypad comprises at least first and second actuators formed of a substantially translucent elastomeric material. A barrier (103) disposed within the first actuator (200) permits light, emitted by a first light source (105), present inside the first actuator (200) to substantially illuminate at least a portion of the first actuator (200) without substantially illuminating the second actuator (505) and permitting light, emitted by a second light source (503), present outside the first (200) and second (505) actuators, to substantially illuminate at least a portion of the first actuator (200) and at least a portion of the second actuator (505). A method for making a selectively illuminated keypad is also disclosed.

24 Claims, 3 Drawing Sheets

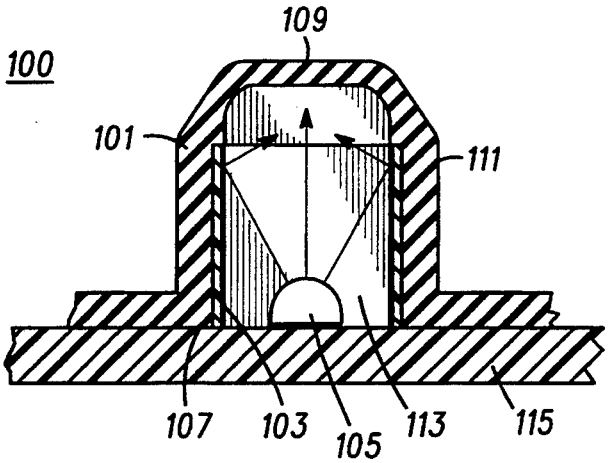
FIG. 1
FIG. 2
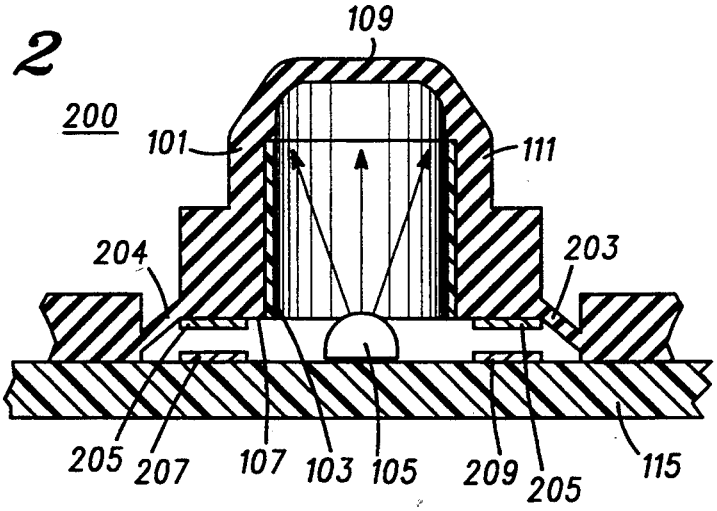
FIG. 3
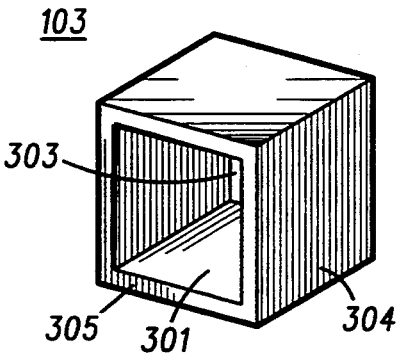
FIG. 4
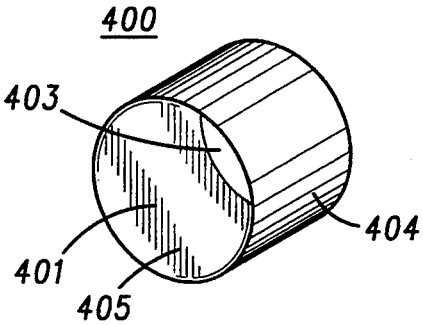

SELECTIVELY ILLUMINATED INDICATOR AND METHOD FOR MAKING THE SAME

FIELD OF THE INVENTION

The present invention relates generally to illuminated keypads and more particularly to a selectively illuminated keypad and method of making the same.

BACKGROUND OF THE INVENTION

Illuminated indicators are commonly provided with electronic devices near or integrated with a display or a keypad of the device to indicate the status of the device.

A problem arises when attempting to selectively illuminate a particular indicator such that light from a selective light source does not bleed into a nearby indicator. This problem has been solved, in general, by placing an opaque barrier between the particular indicator and the nearby indicator. Typical opaque barriers include an opaque housing wall disposed between the particular indicator and the nearby indicator and an opaque paint coating the side surfaces of the particular indicator. Thus, the light emitted within the particular indicator is prohibited from being coupled to the nearby indicator. While these solutions have proven effective for some applications they leave much to be desired in others.

For instance, when the selectively illuminated indicator is a particular actuator of a keypad, the opaque barrier also prohibits illumination of the actuator from a general light source used to illuminate several actuators. In order to illuminate all the actuators of the keypad including the particular actuator, the selective light source in addition to the general light source is activated resulting in increased current drain. Furthermore, a second selective light source is added in some cases (such as when using light emitting diode lighting) to produce selective illumination of the particular actuator in a color different than that emitted by the general light source while providing illumination of all the actuators in one color.

Therefore, there is a need for an improved selectively illuminated keypad and method of making the same.

BRIEF DESCRIPTION OF THE DRAWINGS

FIG. 1 is a cross-sectional view of a selectively illuminated indicator constructed in accordance with the present invention.

FIG. 2 is a cross-sectional view of a selectively illuminated actuator including the selectively illuminated indicator of FIG. 1.

FIG. 3 is a perspective view of a preferred embodiment of a barrier shown in FIGS. 1 and 2.

FIG. 4 is a perspective view of an alternate embodiment of the barrier shown in FIG. 3.

SUMMARY OF THE INVENTION

Figure 5:
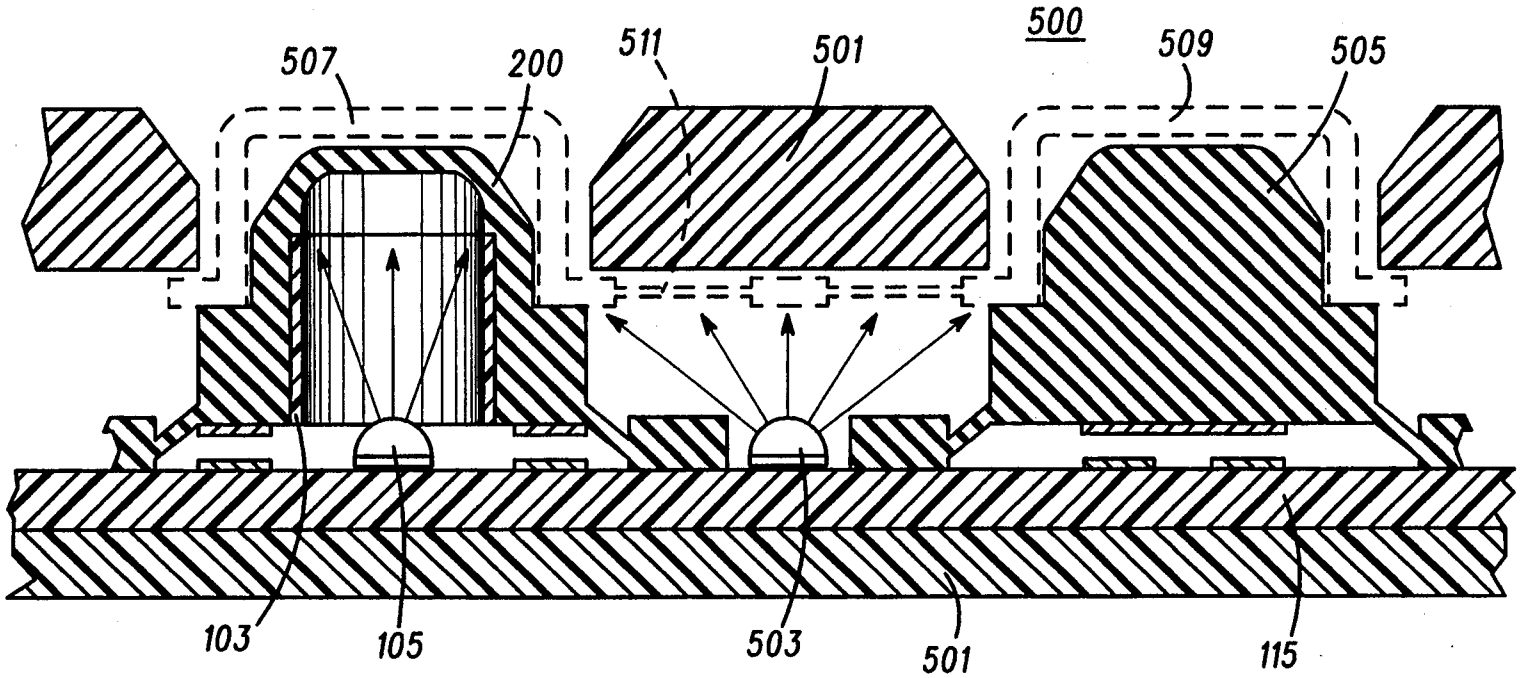
FIG. 5 is a cross-sectional view of a keypad assembly including the selectively illuminated actuator of FIG. 2.

A keypad comprises a first actuator, a second actuator and a barrier. The first and second actuators are formed of a substantially translucent material. The barrier is disposed within the first actuator permitting light, emitted by a first light source, present inside the first actuator to substantially illuminate at least a portion of the first actuator without substantially illuminating the second actuator and permitting light, emitted by a second light source, present outside the first and second actuators, to substantially illuminate at least a portion of the first actuator and at least a portion of the second actuator.

A method for making a selectively illuminated keypad comprises the steps of forming at least a first second and a second actuator of a substantially translucent material; and disposing a barrier within the first actuator permitting light, emitted by a first light source, present inside the first actuator to substantially illuminate at least a portion of the first actuator without substantially illuminating the second actuator, and permitting light, emitted by a second light source, present outside the first and second actuators, to substantially illuminate at least a portion of the first actuator and at least a portion of the second actuator.

DETAILED DESCRIPTION OF A PREFERRED EMBODIMENT

The problems associated with selectively illuminating an indicator are solved, conceptually, by forming the indicator of a translucent material and disposing a barrier within the indicator rather than on the surface of the indicator or between indicators. In a keypad application, the barrier disposed within the actuator permits light emitted by a selective light source to illuminate an actuator without substantially illuminating nearby actuators and permits light emitted by a general light source to illuminate both the actuator and the nearby actuators.

Referring now to FIG. 1, there is shown a cross-sectional view of a selectively illuminated indicator 100 constructed in accordance with the present invention. The selectively illuminated indicator 100 is preferably employed in an electronic device to provide an indication of the device's status.

The indicator 100 includes a substrate 101, a barrier 103 and a specific light source 105. The substrate 101 is formed of a substantially translucent material such as silicone or plastic. The substrate 101 has a first, bottom, side 107, a second, top, side 109 and third, middle, side 111 wherein the middle side 111 is disposed between the bottom side 107 and the top side 109.

The barrier 103 is disposed within the substrate 101, substantially beneath its outer surface, permitting light emitted by the specific light source 105 to substantially illuminate at least a portion the second side and prohibiting the light from illuminating at least a portion of the third side.

A variety of techniques may be used to dispose the barrier 103 in the substrate 101. In the preferred embodiment, the barrier 103 is shown disposed in a hole 113 formed in the first side 107 and extending at least partially towards the second side 109 of the substrate 101. The barrier 103 acts as a liner for the hole 113 (see FIG. 3). The barrier 103 is preferably made of the same material as the substrate 101 and overmolded into the substrate 101 to secure its position. Other techniques to dispose the barrier 103 in the substrate include: integrally molding the barrier 103 with the substrate 101 such that the translucent material of the substrate 101 fills the hole 113, selectively coating the surface of the hole 113 with an opaque substance such as white paint, and selectively coating an exterior surface of a substantially translucent light pipe with a substantially opaque substance (see FIG. 4) and disposing the light pipe in the hole 113.

A mounting substrate 115, conventionally formed as a printed circuit board, provides support for the substrate 101 and the specific light source 105 and has contacts for providing power to the specific light source. The light source 105 is preferably a light emitting diode but may be an incandescent bulb or a fiber optic light emitter.

Conventional graphics such as positive or negative image legends may be optionally included on the top side 109 of the substrate 101 for providing additional information during illumination.

Referring now to FIG. 2 there is shown a cross-sectional view of a selectively illuminated actuator 200 including the selectively illuminated indicator 100 of FIG. 1. The actuator 200 includes the indicator 100 and legs 203 and 204. The actuator 200 is operative to actuate a switch including a pad 205 disposed on the bottom side 107 of the substrate 101 and switch contacts 207 and 209 disposed on the mounting substrate 115.

The operation of the actuator is typical of conventional elastomeric membrane keypads formed of translucent silicone material and used as data input devices.

The legs 203 and 204 are formed of the same material as the substrate 101 and have a thin cross-section permitting the substrate 101 to be suspended above the mounting substrate 115 and permitting the substrate to collapse against the mounting substrate 115 under pressure applied on the top side 109 of the substrate 101.

The pad 205 is electrically conductive and coupled to the bottom side 107 of the substrate 101 and positioned opposite to the switch contacts 207 and 209 on the mounting substrate 115. The pad 205 produces a closed circuit condition between the switch contacts 207 and 209 when pressure is applied to the top side 109 of the substrate 101 and an open circuit condition between the switch contacts 207 and 209 upon release of the applied pressure.

The specific light source 105 preferably has a relatively narrow viewing angle, such as less than 90°, to lessen the likelihood that light emitted by the specific light source 105 would bleed to a nearby actuator via a path between the bottom side 107 of the substrate 101 and the mounting substrate 115.

Implementing the indicator 100 of the present invention with the actuator 200 permits light emitted by the specific light source 105 to substantially illuminate at least a portion the top side 107 and prohibits the light from illuminating at least a portion of the middle side 111.

Referring now to FIG. 3 there is shown a perspective view of a preferred embodiment of a barrier 103 shown in FIGS. 1 and 2. The barrier 103 is a hollow structure forming a liner open at both ends 301 and 303 separated by a lateral side 304 thereby defining a cross-section 305. The barrier 103 may be formed of a variety of materials being the same or different than the substrate 101 of FIG. 1 including silicone or plastic. Preferably, the barrier 103 is an opaque color such as white for its reflective properties. However, the barrier 103 may alternatively be formed of a translucent material and have an opaque coating disposed on the lateral side 304 thereof. The barrier is disposed within the substrate 101 such that the open end 301, the open end 303 and the lateral side 304 are disposed essentially opposite to the bottom side 107, the top side 109 and the middle side 111, respectively of the substrate 101.

Referring now to FIG. 4 there is shown a perspective view of an alternate embodiment of a barrier shown in FIG. 3. The barrier 400 is a solid structure open at both ends 401 and 403 separated by a lateral side 404 thereby defining a cross-section 405. The barrier 103 may be formed of a variety of materials being the same or different than the substrate 101 of FIG. 1 including silicone or plastic. Preferably, the barrier 103 is formed of a translucent material to provide the reflective properties of a light pipe and having an opaque coating disposed on the lateral side 404 thereof. The barrier is disposed within the substrate 101 such that the open end 401, the open end 403 and the lateral side 404 are disposed essentially opposite to the bottom side 107, the top side 109 and the middle side 111, respectively of the substrate 101.

Referring now to FIG. 5 there is shown a cross-sectional view of a keypad assembly 500 including the selectively illuminated actuator 200 of FIG. 2. The keypad assembly 500 includes a housing 501, a mounting substrate 115, a specific light source 105, a general light source 503 and a keypad 200 and 505 adapted to be disposed between the housing 501 and the mounting substrate 115.

Key caps 507 and 509, shown in hatch, may be optionally disposed over the actuators 200 and 505, respectively, to provide a different look and feel of the actuator for the user while maintaining the switch function of the actuator. The key caps are shown interconnected by a thin, flexible arm organizing the key caps into what is commonly known as a key tree. The present invention advantageously permits the use of the key tree since there are no longer prior art housing walls to separate actuators to control specific lighting.

The general light source 508 preferrably has a relatively wide light emitting viewing angle, such as greater than 90°, to provide general lighting for more than one actuator.

The barrier 103 permits light emitted by the selective light source 105 to substantially illuminate at least a portion of the actuator 200 without substantially illuminating the nearby actuator 505 and permits light emitted by a general light source 503 to substantially illuminate at least a portion of the actuator 200 and at least a portion of the nearby actuator 505.

The present invention has definite advantages over the prior art. When the selectively illuminated indicator 100 is a particular actuator 200 of a keypad, the position of the opaque barrier 103 within the actuator 200 also permits illumination of the actuator 200 from a general light source used to illuminate both the particular actuator 200 and a nearby actuator 505. In order to illuminate both actuators 200 and 505, the selective light source is turned off and the general light source is activated resulting in decreased current drain when compared to the prior art.

Furthermore, a second selective light source need not be added to produce selective illumination of the particular actuator 200 in a color different than that emitted by the general light source 503 while providing illumination of both actuators 200 and 505 in the one color emitted by the general light source 503. Thus, any particular actuator can be specifically illuminated to highlight the specific functionality of that actuator regardless whether the general backlighting 503 is illuminated. If the general lighting 503 is illuminated, the light color emitted by the specific light source will dominate over the general light color in the particular actuator because of its close proximity.

Figure 6:
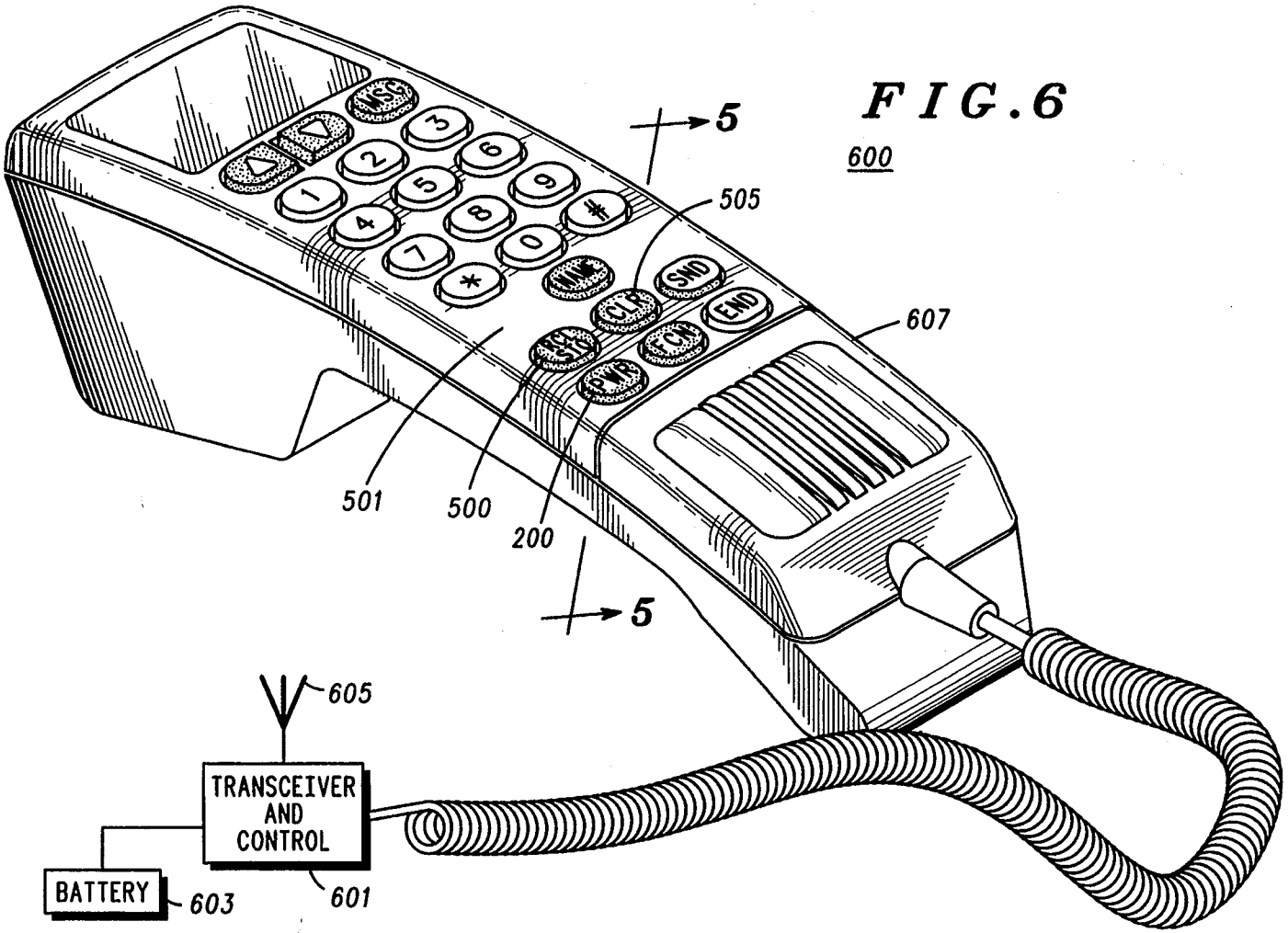
FIG. 6 is a block diagram of a radio telephone including the keypad assembly of FIG. 5.

Referring now to FIG. 6, there is shown a diagram of a radio telephone 600 including the keypad assembly 500 of FIG. 5. The radio telephone 600 includes a top perspective view of a user interface handset 607 including the keypad 500 of FIG. 5, a transmitter, a receiver and a controller shown as a transceiver/controller 601, a power source such as a battery 603 and an antenna 605. Such generally referred to elements are well understood in the art, and hence no additional description need be provided here except as may be necessary to indicate interaction between these typical components of a radio transceiver and the preferred embodiment of the present invention.

The handset 607 includes the keypad assembly 600 having the novel selectively illuminated actuator 200 constructed in accordance with the present invention.

The radio telephone 600 is adapted for use in a moving vehicle or for hand carrying by a user. The present invention also may be incorporated into any type of electronic equipment requiring data or control input or visible indication such as portable radio telephones, cordless radiotelephones, data terminals, computers, pocket organizers and remote control modules.

What is claimed is:

1. A keypad comprising:

at least first and second actuators formed of a substantially translucent material; and a barrier disposed within the first actuator permitting lights emitted by a first light source, present inside the first actuator to substantially illuminate at least a portion of the first actuator without substantially illuminating the second actuator and permitting light, emitted by a second light source, present outside the first and second actuators, to substantially illuminate at least a portion of the first actuator and at least a portion of the second actuator.

2. A keypad according to claim 1 wherein each of the first and second actuators further comprise;

an electrically conductive pad, adapted to be positioned opposite switch contacts coupled to a printed circuit board, permitting a closed circuit condition between the switch contacts upon actuation of at least one of the first and second actuators and an open circuit condition between the switch contacts upon release of the at least one of the first and second actuators.

3. A keypad in accordance with claim 1 wherein the barrier is disposed in a hole formed in the first actuator.

4. A keypad in accordance with claim 3 wherein the barrier further comprises a substantially opaque substance selectively coating a surface of the hole.

5. A keypad in accordance with claim 1 wherein the barrier further comprises a substantially translucent light pipe having an exterior surface selectively coated with a substantially opaque substance.

6. A keypad in accordance with claim 1 wherein the barrier further comprises a substantially opaque liner.

7. A keypad assembly comprising:

a housing;

a circuit board coupled to the housing;

a first light source coupled to the circuit board and operative to emit light;

a keypad formed of an elastomeric membrane and disposed between the housing and the circuit board, including:

at least one actuator formed of a substantially translucent material and having first, second and third sides, the third side disposed between the first side and the second side; and a barrier disposed within the actuator permitting the light, present inside the actuator, to substantially illuminate at least a portion of the second side and prohibiting the light from illuminating at least a portion of the third side; and a switch coupled to the circuit board and capable of being actuated responsive to movement of the actuator.

8. A keypad assembly in accordance with claim 7 further comprising a second light source coupled to the circuit board and operative to emit light to substantially illuminate at least a portion of the at least one actuator and at least a portion of at least one other actuator.

9. A keypad assembly in accordance with claim 7 wherein the barrier is disposed in a hole formed in the first side and extending at least partially towards the second side.

10. A keypad assembly in accordance with claim 9 wherein the barrier further comprises a substantially opaque substance selectively coating a surface of the hole.

11. A keypad assembly in accordance with claim 7 wherein the barrier further comprises a substantially translucent light pipe having an exterior surface selectively coated with a substantially opaque substance.

12. A keypad assembly in accordance with claim 7 wherein the barrier further comprises a substantially opaque liner.

13. A method for making a selectively illuminated keypad comprising the steps of:

forming at least a first second and a second actuator of a substantially translucent material; and disposing a barrier within the first actuator permitting light, emitted by a first light source, present inside the first actuator to substantially illuminate at least a portion of the first actuator without substantially illuminating the second actuator, and permitting light, emitted by a second light source, present outside the first and second actuators, to substantially illuminate at least a portion of the first actuator and at least a portion of the second actuator.

14. A method for making a selectively illuminated keypad in accordance with claim 13 wherein the step of disposing further comprises the steps of:

forming a hole in the first actuator;

selectively coating an exterior surface of a substantially translucent light pipe with a substantially opaque substance to form the barrier; and positioning the light pipe in the hole.

15. A method for making a selectively illuminated keypad in accordance with claim 13 wherein the step of disposing further comprises the step of:

integrally molding the barrier within the first actuator.

16. A method for making a selectively illuminated keypad in accordance with claim 13 wherein the step of disposing further comprises the steps of:

overmolding the barrier within the first actuator.

17. A method for making a selectively illuminated keypad in accordance with claim 13 wherein the step of disposing further comprises the steps of:

forming a hole in the first actuator; and placing a substantially opaque liner in the hole to form the barrier.

18. A method for making a selectively illuminated keypad in accordance with claim 13 wherein the step of disposing further comprises the steps of:

forming a hole in the first actuator; and selectively coating a surface of the hole with a substantially opaque substance to form the barrier.

19. A keypad assembly comprising:

a housing;

a circuit board coupled to the housing;

a first light source and a second light source coupled to the circuit board, wherein each of the first and second light sources are operative to emit light;

a keypad formed of an elastomeric membrane and disposed between the housing and the circuit board, including:

at least first and second actuators formed of a substantially translucent material; and a barrier disposed within the first actuator permitting light, emitted by a first light source, present inside the first actuator to substantially illuminate at least a portion of the first actuator without substantially illuminating the second actuator and permitting light, emitted by a second light source, present outside the first and second actuators, to substantially illuminate at least a portion of the first actuator and at least a portion of the second actuator; and at least first and second switches coupled to the circuit board and capable of being actuated responsive to movement of the at least first and second actuators, respectively.

20. A keypad assembly in accordance with claim 19 wherein the barrier is disposed in a hole formed in the first actuator.

21. A keypad assembly in accordance with claim 20 wherein the barrier further comprises a substantially opaque substance selectively coating a surface of the hole formed in the first actuator.

22. A keypad assembly in accordance with claim 19 wherein the barrier further comprises a substantially translucent light pipe having an exterior surface selectively coated with a substantially opaque substance.

23. A keypad assembly in accordance with claim 19 wherein the barrier further comprises a substantially opaque liner.

24. A radiotelephone comprising:

a transmitter; and a keypad for providing data to the transmitter including:

at least first and second actuators formed of a substantially translucent material; and a barrier disposed within the first actuator permitting light, emitted by a first light source, present inside the first actuator to substantially illuminate at leant a portion of the first actuator without substantially illuminating the second actuator and permitting light, emitted by a second light source, present outside the first and second actuators, to substantially illuminate at least a portion of the first actuator and at least a portion of the second actuator.

* * * * *